US007638763B2

(12) United States Patent
Guckenberger et al.

(10) Patent No.: US 7,638,763 B2
(45) Date of Patent: Dec. 29, 2009

(54) METHOD AND APPARATUS FOR SCALING INTENSITY DATA IN A MASS SPECTROMETER

(75) Inventors: George B. Guckenberger, Austin, TX (US); Scott T. Quarmby, Round Rock, TX (US)

(73) Assignee: Thermo Finnigan LLC, San Jose, CA (US)

( * ) Notice: Subject to any disclaimer, the term of this patent is extended or adjusted under 35 U.S.C. 154(b) by 378 days.

(21) Appl. No.: 11/800,150

(22) Filed: May 4, 2007

(65) Prior Publication Data

US 2008/0272288 A1 Nov. 6, 2008

(51) Int. Cl.
*H01J 49/00* (2006.01)

(52) U.S. Cl. ..... 250/282; 250/281; 250/286; 250/287; 250/288; 436/173; 702/22; 702/23; 702/27; 702/28

(58) Field of Classification Search ..... 250/281, 250/282, 286, 287, 288; 436/173; 702/22, 702/23, 27, 28
See application file for complete search history.

(56) References Cited

U.S. PATENT DOCUMENTS 5,572,022 A 11/1996 Schwartz et al.
6,787,760 B2 9/2004 Belov et al.
6,982,415 B2 * 1/2006 Kovtoun ..... 250/282
6,987,261 B2 * 1/2006 Horning et al. ..... 250/282
7,112,787 B2 * 9/2006 Mordehal ..... 250/292
2003/0057370 A1 * 3/2003 Youngquist et al. ..... 250/287
2004/0217272 A1 * 11/2004 Horning et al. ..... 250/282
2006/0016978 A1 1/2006 McCauley et al.

* cited by examiner

*Primary Examiner*—David A Vanore
*Assistant Examiner*—Michael Maskell
(74) *Attorney, Agent, or Firm*—Sharon Upham; Thomas F. Cooney; Haynes and Boone, LLP

(57) ABSTRACT

A method includes: accumulating ions having a plurality of m/z values in an ion trap during a time interval; deriving from the accumulated ions a respective intensity value for each of the m/z values; and adjusting each of the intensity values as a function of the time needed by the ion trap to begin collecting ions with the corresponding m/z value. According to a different aspect, an apparatus includes a first portion with an ion trap, and a second portion. The second portion causes the ion trap to accumulate ions with a plurality of m/z values during a time interval, derives from the accumulated ions in the ion trap a respective intensity value for each of the m/z values, and adjusts each of the intensity values as a function of the time needed by the ion trap to begin collecting ions with the corresponding m/z value.

18 Claims, 3 Drawing Sheets

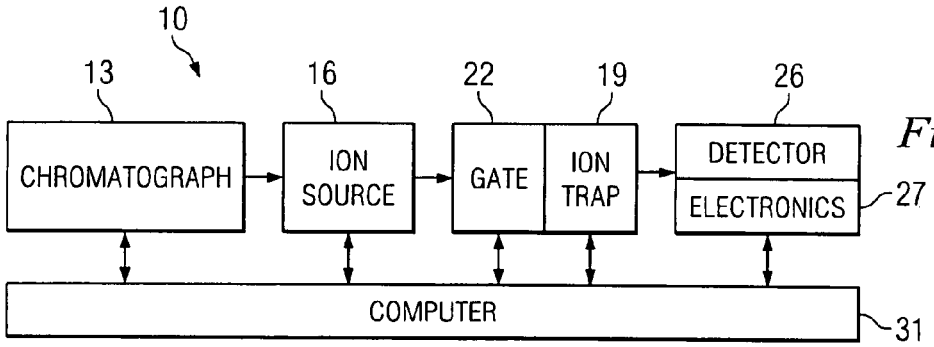
*Fig. 1*
*Fig. 2*
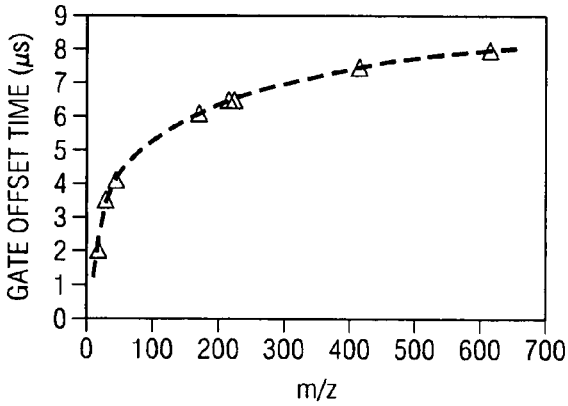
*Fig. 5*
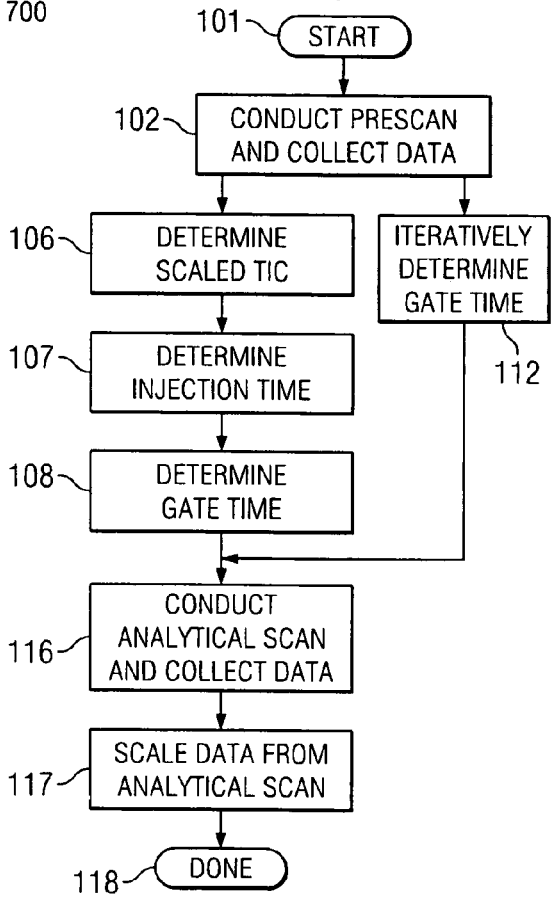

METHOD AND APPARATUS FOR SCALING INTENSITY DATA IN A MASS SPECTROMETER

TECHNICAL FIELD

This invention relates in general to mass spectrometry and, more particularly, to data scaling techniques for mass spectrometry.

BACKGROUND

In an ion trap mass spectrometer, the ion population collected by the ion trap during an analytical scan is typically regulated using a technique called automatic gain control (AGC). More specifically, before the analytical scan, a prescan is carried out by opening the gate of the ion trap for a predetermined time interval, and then determining the population of ions collected during that time interval. This ion population is typically referred to as the total ion current (TIC). Based on the TIC determined for the prescan time interval, an ion injection time is determined for use during the subsequent analytical scan. The ion injection time is determined with the goal of filling the ion trap to a point where it contains a desired number of ions, sometimes referred to as the AGC target value. In this regard, each ion trap has an AGC target value associated with it, representing approximately the maximum number of ions that the ion trap can hold without producing undesirable effects, such as where ions with a large mass-to-charge ratio (m/z) cause space charge effects for lower m/z ions.

It is known in the art that the gate of an ion trap must be open for a certain minimum period of time before the ion trap will begin to collect ions. This minimum period of time is typically referred to as the gate offset time. In pre-existing systems, the gate offset time was assigned a constant value, such as 1.5 μsec, for the entire m/z range of interest. This 1.5 μsec offset time was added to the injection time calculated from the prescan data, in order to determine the gate time during which the gate would be open for the analytical scan. The analytical scan was then carried out using this gate time. Where the analytical scan was a full scan across a wide range of m/z, the number of ions trapped for each m/z would vary with the length of the calculated injection time. Consequently, the data collected during the analytical scan needed to be normalized, and was therefore scaled by dividing the detected ion intensity for each m/z by the injection time calculated from the prescan data. Although this conventional scaling technique has been generally adequate for its intended purpose, it has not been satisfactory in all respects.

SUMMARY

One of the broader forms of the invention involves a method that includes: accumulating ions having a plurality of m/z values in an ion trap during a time interval; deriving from the accumulated ions a respective intensity value for each of the m/z values; and adjusting each of the intensity values as a function of the time needed by the ion trap to begin collecting ions with the corresponding m/z value.

Another of the broader forms of the invention involves an apparatus that includes a first portion with an ion trap, and a second portion. The second portion causes the ion trap to accumulate ions with a plurality of m/z values during a time interval, derives from the accumulated ions in the ion trap a respective intensity value for each of the m/z values, and adjusts each of the intensity values as a function of the time needed by the ion trap to begin collecting ions with the corresponding m/z value.

BRIEF DESCRIPTION OF THE DRAWINGS

In the accompanying drawings:

FIG. 1 is a block diagram of a mass spectrometer apparatus that embodies aspects of the invention, and that includes an ion trap with a gate.

FIG. 2 is a graph showing the variation with mass-to-charge ratio of an offset time that is associated with the gate of the ion trap in FIG. 1.

FIG. 5 is a high-level flowchart depicting a process that utilizes some of the techniques of the invention.

DETAILED DESCRIPTION

Figure 3:
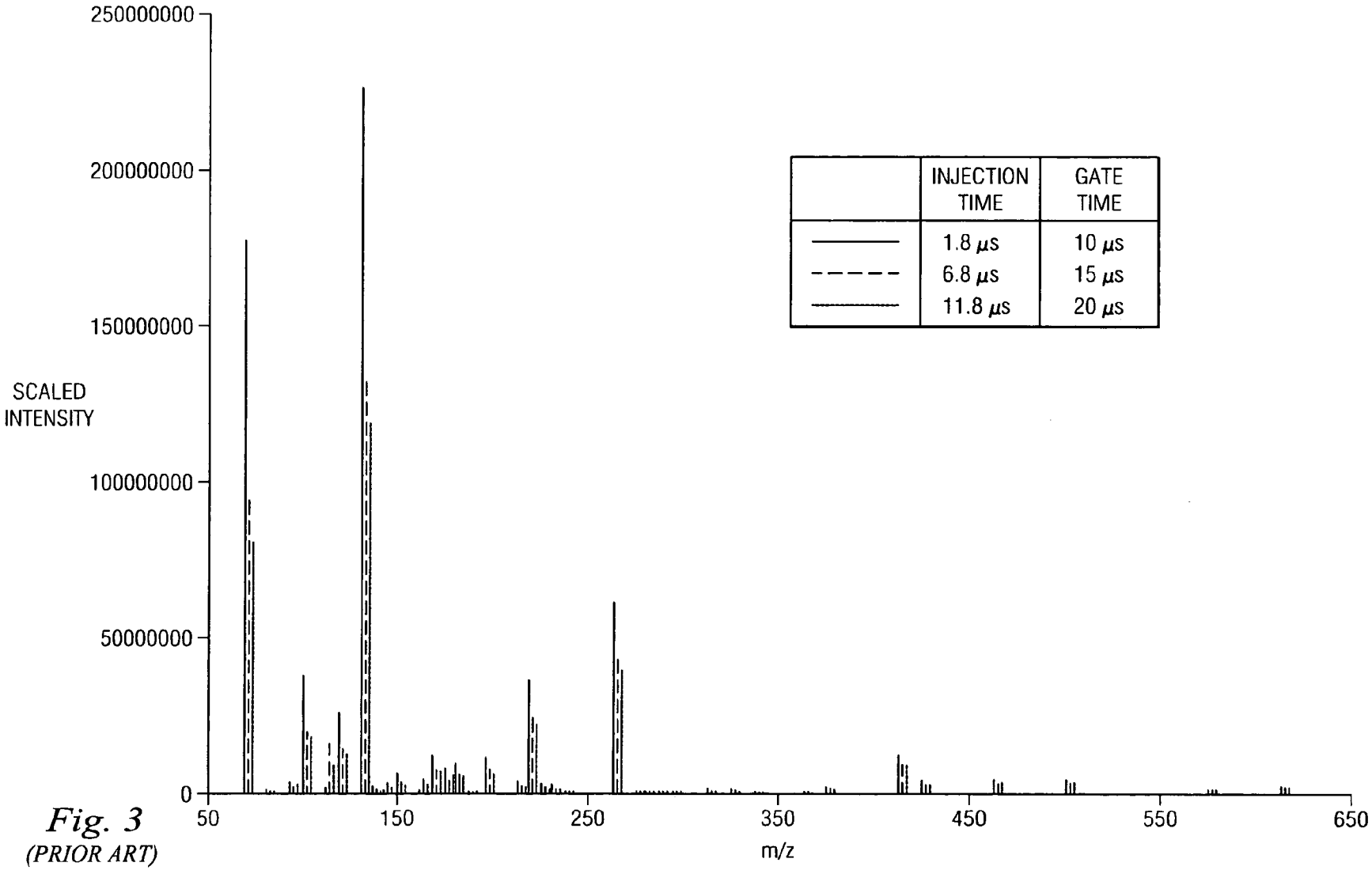
Fig. 3 (PRIOR ART)
FIG. 3 is a graph showing data from each of three separate analytical scans conducted with the same sample material using the mass spectrometer of FIG. 1, where the data has been scaled using a conventional technique.

FIG. 1 is a block diagram of a mass spectrometer apparatus 10 that embodies aspects of the invention. The apparatus 10 includes a chromatograph 13, an ion source 16, an ion trap 19 with a gate 22, a detector 26 with associated electronics 27, and a computer 31 that is operatively coupled to the chromatograph 13, ion source 16, gate 22, ion trap 19 and electronics 27. FIG. 1 is not a comprehensive diagram of the entire mass spectrometer apparatus. Instead, for simplicity and clarity, FIG. 1 shows only portions of the overall apparatus that facilitate an understanding of the present invention.

In the disclosed embodiment, the chromatograph 13 is a known type of device, and in fact could be any of a number of existing devices, including a commercially-available liquid chromatograph or gas chromatograph. Alternatively, the chromatograph 13 could be any other suitable type of device. As known in the art, the chromatograph 13 is provided with a not-illustrated sample of a material to be analyzed, and then outputs atoms or molecules of the sample material that are referred to as analytes. The analytes produced by the chromatograph 13 are delivered to the ion source 16 in a manner known in the art. For example, the analytes can be delivered from the chromatograph 13 to the ion source 16 through a commercially-available liquid chromatograph (LC) column or gas chromatograph (GC) column.

In the disclosed embodiment, the ion source 16 is also a device of a known type, and in particular could be any of a wide variety of commercially available ion sources. Alternatively, the ion source 16 could be any other suitable device. As known in the art, the ion source 16 takes the analytes that it receives from the chromatograph 13, and uses them to produce ions of the sample material. For example, the ions may be produced using a known technique such as electron ionization (EI) or chemical ionization (CI). The ion source outputs the resulting ions toward the ion trap 19.

The gate 22 is a known device that selectively controls the entry of ions into the ion trap 19. In the disclosed embodiment, the gate 22 is a commercially-available device, but could alternatively be any other suitable type of device, or may be part of the ion trap 19. The gate 22 in the disclosed embodiment receives a control voltage that varies from +100 volts to −100 volts. When this control voltage is more negative than about −5 volts, positive ions can pass through the gate 22 and into the ion trap 19. Otherwise, the gate 22 does not pass positive ions. It takes a short but finite amount of time for the gate voltage to transition from +100 volts to −100 volts, for example about 3 μsec. Similarly, it takes a short but finite amount of time for the gate voltage to transition from −100 volts to +100 volts. These two transition times may be different.

The ion trap 19 is a device that can collect or trap ions. In the disclosed embodiment, the ion trap 19 is a commercially-available device of a type known as a three-dimensional quadrupole ion trap, but it could alternatively be any other suitable type of ion trap, including but not limited to a linear ion trap, a rectilinear ion trap, a cylindrical ion trap, an electrostatic ion trap, or a Fourier transform ion cyclotron resonance (FTICR) mass spectrometer.

The detector 26 can measure the concentration or intensity of the ions trapped by the ion trap 19, at each of a variety of different mass-to-charge ratios (m/z). In the disclosed embodiment, the detector 26 is a commercially-available device, but it could alternatively be any other suitable device. The electronics 27 associated with the detector 26 have the capability to process data collected by the detector. In the disclosed embodiment, the electronics 27 include a not-illustrated digital signal processor (DSP), and this DSP facilitates high-speed processing of data from the detector.

The computer 31 cooperates with the chromatograph 13, ion source 16, gate 22, ion trap 19 and electronics 27, in order to further process data from the electronics 27 and detector 26, and in order to synchronize and control the operation of the various different components of the mass spectrometer apparatus 10. The computer 31 and the not-illustrated DSP in the electronics 27 each execute a program based on software that is known in the art, but that has been modified to include some aspects of the invention that are discussed in detail below.

The mass spectrometer apparatus 10 can conduct a prescan, followed by an analytical scan. In this regard, each ion trap has a target value associated with it, representing approximately the maximum number of ions that the ion trap can hold without producing undesirable effects, such as where ions with a large mass-to-charge ratio (m/z) cause space charge effects for lower m/z ions. The fundamental purpose of the prescan is to determine a gate time during which the gate 22 will be open for the subsequent analytical scan, with the goal of filling the ion trap to (but not beyond) its target concentration of ions.

During the prescan, the ion trap is typically not filled to its target concentration. Instead, the gate 22 is opened for a predetermined period of time that allows the ion trap to collect ions for a range of m/z values, but not enough ions to reach the target concentration. Then, the detector 26 determines the intensity or concentration of ions within the ion trap for each of a plurality of different m/z. Next, this information is used by the computer 31 and/or electronics 27 to determine an appropriate gate time for which the gate 22 will be opened during the subsequent analytical scan. The apparatus 10 then conducts the analytical scan, where the gate 22 is opened for the gate time determined on the basis of the prescan. While the gate is open for the analytical scan, the ion trap 19 collects ions, and then the detector 26 detects the ion population or intensity within the ion trap 19 for each of a plurality of different m/z. The data collected by the detector 26 during the analytical scan is then processed by the electronics 27 and/or the computer 31.

During any scan, the gate 22 must open for a minimum period of time before the ion trap 19 will collect any ions. This minimum period of time is referred to as the gate offset time, and varies with m/z. This is believed to be due at least in part to the fact that, since kinetic energy is constant, the flight time of ions varies with m/z, including the flight time of ions through the gate. A further consideration is that, as discussed above, it takes a small but finite amount of time for the gate 22 to switch from a mode in which it rejects ions to a mode in which it passes ions, and also a small but finite amount of time to switch from a mode in which it passes ions to a mode in which it rejects ions. FIG. 2 is a graph showing how the gate offset time varies with m/z for the ion trap 19 in the disclosed embodiment. It will be noted that the gate offset time is approximately 4.2 μsec for m/z 50, and approximately 8.2 μsec for m/z 650. In other words, the gate offset time for m/z 650 is almost twice the gate offset time for m/z 50.

In order to trap ions of m/z 50, the gate 22 would ideally be activated for the corresponding gate offset time of 4.2 μsec, followed by a selected injection time during which the ions are actually collected. Similarly, in order to trap ions of m/z 650, the gate would ideally be activated for the corresponding gate offset time of 8.2 μsec, followed by the selected injection time. However, during an analytical scan of the type commonly referred to as a full scan, ions having a wide range of m/z are simultaneously trapped in the ion trap 19. For example, the ion trap 19 is readily capable of simultaneously trapping ions with m/z values ranging from 50 to 650. If a low gate offset time such as 4.2 μsec is used, ions with a relatively small m/z 50 will be trapped, but ions with a large m/z such as 650 may not be trapped at all. For example, assume hypothetically that the gate 22 is activated for a gate time of 6.0 μsec, determined by adding a gate offset time of 4.2 μsec to a desired injection time of 1.8 μsec. With reference to FIG. 2, ions with a m/z greater than about 170 would not be trapped at all, because the 6.0 μsec duration of the gate activation would be less than the gate offset time for these larger m/z. In other words, the gate would not be open long enough to collect any ions with a m/z greater than about 170. Consequently, in order to trap ions at all m/z throughout a wide range, trapping should be carried out using the gate offset time for the largest m/z that is of interest. This is expressed by the equation:

$$GT_A = IT + \mathrm{Max}[OT(m/z)] \quad (1)$$

where $GT_A$ is the gate time for the analytical scan, IT is the injection time for actual ion collection during the analytical scan, and OT(m/z) is the gate offset time (from FIG. 2) for the largest m/z that is of interest.

Using the gate offset time for the largest m/z of interest provides relatively ideal trapping of ions with that particular m/z. However, most other ions have lower m/z values, and use of the maximum gate offset time is non-ideal for them. In particular, the maximum gate offset time will be larger than ideal for those ions of lower m/z, such that the gate will be open longer than the ideal time for those ions. For example, assume hypothetically that the gate 22 is activated for a gate time of 10.0 μsec, including a gate offset time of 8.2 μsec plus a desired injection time of 1.8 μsec. With reference to FIG. 2, ions with a m/z of 50 have a corresponding gate offset time of only about 4.2 μsec. Therefore, after the first 4.2 μsec of the 10.0 μsec gate time, the ion trap 19 will collect ions for the remaining 5.8 μsec of the 10.0 μsec gate time, which is 4 μsec longer than the desired injection time of 1.8 μsec. Consequently, since the ion trap will be trapping ions of m/z 50 longer than desired, the ion trap will collect too many ions of m/z 50. In order to compensate for this, the intensity data for the trapped ions is scaled.

FIG. 3 is a graph showing scaled data resulting from each of three separate analytical scans using the same sample material, where the scaling is carried out with a conventional scaling technique. Each of the three scans used the same gate offset time of 8.2 μsec, corresponding to a m/z of 650, representing the largest ions of interest. The three scans were carried out with respective different injection times of 1.8 μsec, 6.8 μsec and 11.8 μsec, producing respective gate times of 10.0 μsec, 15.0 μsec and 20.0 μsec. FIG. 3 shows the result of using the conventional scaling technique, in which the raw intensity data for each m/z is divided by the injection time used for that particular scan (1.8 μsec, 6.8 μsec or 11.8 μsec). It will be noted that, for ions with higher m/z, the scaled values from the three scans are approximately equal for each m/z. However, for ions with lower m/z, the scaled values for any given m/z vary radically with respect to each other. In order to avoid this type of inaccuracy, the disclosed embodiment uses a different scaling technique.

Figure 4:
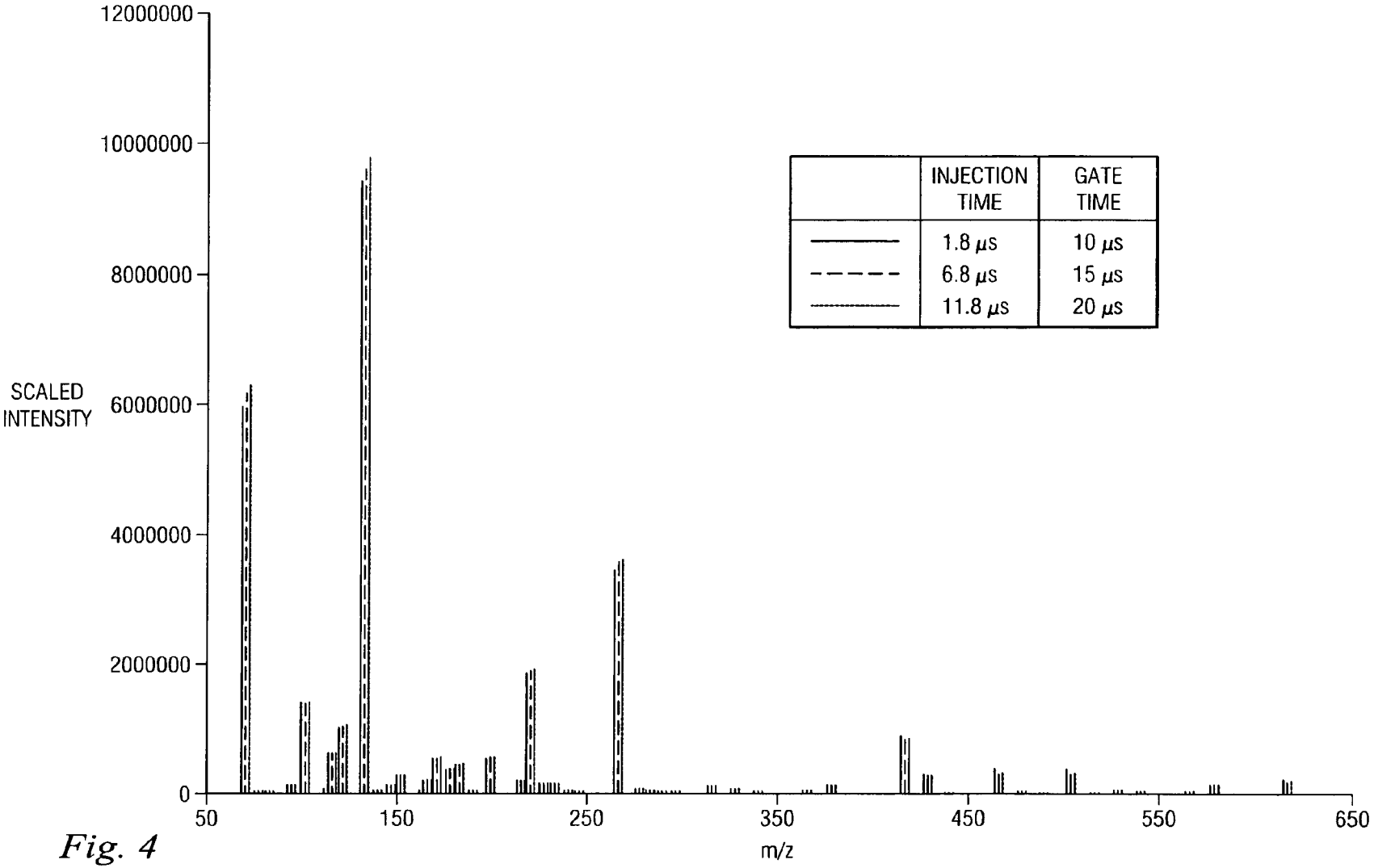
FIG. 4 is a graph that is similar to FIG. 3 and that is based on the data from the same three scans, except that the data has been scaled using one of the techniques of the invention.

More specifically, scaling for each m/z is carried out according to the equation:

$$SI(m/z) = \frac{I_A(m/z)}{GT_A - OT(m/z)} \tag{2}$$

where SI(m/z) is the scaled intensity for a respective m/z, $I_A$(M/Z) is the measured ion intensity for that m/z, $GT_A$ is the gate time used for that analytical scan, and OT(m/z) is the respective gate offset time for that m/z (as specified by FIG. 2). $GT_A$ should be larger than the gate offset time OT(m/z) for the largest m/z of interest, in order to avoid either division by zero or division by a negative number. FIG. 4 is a graph similar to the graph of FIG. 3, but showing the result of scaling the data with Equation (2), rather than the conventional scaling technique. It will be noted from FIG. 4 that, for each m/z, the three scaled values from the three different scans are almost identical. Stated differently, the scaled data is highly accurate across the entire spectrum of ions collected.

The scaling discussed above in association with Equation (2) relates to scaling of the data collected during an analytical scan. As explained earlier, an analytical scan is normally preceded by a prescan, and the data collected during the prescan is used to determine the gate time $GT_A$ that is to be used for the subsequent analytical scan. It is possible to separately and independently perform scaling in association with the data collected during the prescan.

More specifically, the prescan involves collection of ions with a wide range of m/z. During the prescan, the gate 22 is activated for a predetermined prescan gate time ($GT_p$). However, due to the gate offset time, ions of each m/z will actually be collected for a time interval that is less than the predetermined gate time $GT_p$. Consequently, the prescan gate time $GT_p$ must be longer than the gate offset time for the largest m/z of interest, or no ions with that large m/z will be collected. Moreover, since the gate offset effect causes ions of each m/z to be collected for a time interval less than the desired prescan gate time $GT_p$, the prescan data needs to be scaled, or else the resulting calculation of a total ion current (TIC) is likely to be smaller than it should be (because the gate offset time causes the gate to effectively be open for a shorter time than intended, and thus fewer ions are collected). If the prescan TIC is smaller than it should be, then when it is used to calculate the injection time for the analytical scan, the injection time will be too long, and the target concentration for the ion trap will likely be exceeded. A further but related consideration is that, since the gate offset time varies with m/z (as shown in FIG. 2), ions with lower m/z values will be collected for a longer time in the prescan than ions with higher m/z values. Therefore, the scaling also needs to account for the fact that gate offset time varies with m/z. In order to effect scaling of prescan data in a manner that accommodates all these considerations, the disclosed embodiment uses the equation:

$$STIC = \sum_{m/z} \frac{I_p(m/z)}{GT_p - OT(m/z)} \tag{3}$$

where STIC is the scaled total ion current, $I_p$(m/z) is the prescan ion concentration for a respective m/z, $GT_p$ is the prescan gate time, and OT(m/z) is the gate offset for the respective m/z. $GT_p$ should be larger than the gate offset time OT(m/z) for the largest m/z of interest, in order to avoid either division by zero or division by a negative number. Based on this scaled total ion current (STIC), the injection time for the subsequent analytical scan can be calculated with the equation:

$$IT = \frac{TC}{STIC} \tag{4}$$

where IT is the injection time for the analytical scan, and TC is the target concentration of ions for the particular ion trap. The injection time IT from Equation (4) can then be used in Equation (1) to calculate the gate time $GT_A$ for the analytical scan.

Even with all of this scaling, if the injection time determined for the analytical scan is relatively short in comparison to the gate offset times, the ion trap might still be underfilled, and not reach the target concentration. Therefore, to avoid this, an alternative technique for scaling the prescan data is provided, and can be used in place of the approach discussed above in association with Equations (1), (3) and (4). In more detail, using the raw data from the prescan, the following equation is solved in an iterative manner using a series of different values for the analytical gate time $GT_A$, in order to identify a gate time $GT_A$ that will ensure the ion trap is filled with the desired number of ions, even for gate times $GT_A$ that are relatively short in comparison to the gate offset time:

$$\sum_{m/z} \left[ \frac{I_p(m/z)}{GT_p - OT(m/z)} \cdot (GT_A - OT(m/z)) \right] = TC \tag{5}$$

where $I_p$(m/z) is the prescan ion intensity for a respective m/z, $GT_p$ is the prescan gate time, OT(m/z) is the gate offset time (FIG. 2) for the respective m/z, and TC is the target concentration of ions for the analytical scan. In effect, Equation (5) accounts for the effect of the gate offset time not only on the prescan, but also on the analytical scan, even before the analytical scan is carried out. In Equation (5), $GT_p$ should be larger than the gate offset time OT(m/z) for the largest m/z of interest, in order to avoid either division by zero or division by a negative number. Similarly, when iteratively solving Equation (5), the series of values used for the gate time $GT_A$ should each be larger than the gate offset time OT(m/z) for the largest m/z of interest, so that the numerator does not involve multiplication by either zero or a negative number.

The ion trap 19 can be viewed as one portion of the disclosed apparatus, and the gate 22, detector 26, electronics 27 and computer 31 can be viewed as a further portion with the capability to cause the ion trap to accumulate ions with a plurality of m/z values during a time interval, derive from the accumulated ions in the ion trap a respective intensity value for each of the m/z values, and then adjust each of the intensity values as a function of the time needed by the ion trap to begin collecting ions with the corresponding m/z value.

FIG. 5 is a high-level flowchart depicting the various techniques discussed above. Processing begins in block 101, and proceeds to block 102, where the apparatus 10 of FIG. 1 conducts a prescan using a predetermined prescan gate time $GT_p$, and collects data for a range of m/z. The data from the prescan can then be processed in one of two different ways. One approach is represented by blocks 106-108, and the other approach is represented by block 112.

In block 106, the prescan data is used to calculate a scaled total ion current (STIC), according to Equation (3). This STIC is then used in block 107 to calculate an injection time (IT) for the analytical scan, using Equation (4). Then, in block 108, the largest m/z that is targeted to be collectible in the analytical scan is identified, in order to then identify the corresponding gate offset time OT(m/z), using the relationship shown in FIG. 2. With reference to Equation (1), this maximum gate offset time is then added to the injection time IT, in order to determine the gate time $GT_A$ to be used in the analytical scan.

Turning now to the alternative approach, the technique of block 112 could optionally be carried out instead of the technique of blocks 106, 107 and 108. In particular, the data collected during the prescan can be used to determine the gate time $GT_A$ for the analytical scan by iteratively solving Equation (5).

From either of blocks 108 and 112, control proceeds to block 116, where the apparatus 10 of FIG. 1 conducts an analytical scan and collects data, using the gate time $GT_A$. Then, in block 117, the data from the analytical scan is scaled, using Equation (2). Processing then ends at block 118.

The flowchart of FIG. 5 shows the use of either disclosed prescan scaling technique to determine the analytical scan gate time, in combination with the disclosed analytical scan scaling technique. However, any of the disclosed scaling techniques can be used with or without any of the other disclosed scaling techniques. As one aspect of this, FIG. 5 shows use of the disclosed analytical scan scaling technique after a prescan has been carried out, but this analytical scan scaling technique can also be used where there is no prescan, for example for data from an analytical scan in which the gate time is either predetermined, or selected in a manner that does not involve conducting a prescan. A different consideration is that the gate time $GT_p$ for the prescan does not necessarily have to be a fixed or predetermined value, but instead could be determined in some other manner, for example as a function of data collected during one or more previous scans.

Although selected embodiments have been illustrated and described in detail, it will be understood that they are exemplary, and that a variety of substitutions and alterations are possible without departing from the spirit and scope of the present invention, as defined by the following claims.

What is claimed is:

1. A method comprising:

selecting a length for a time interval as a function of a plurality of m/z values of ions that will be accumulated in an ion trap;

accumulating the ions having the plurality of m/z values in the ion trap during the time interval;

deriving from the accumulated ions a respective intensity value for each of the m/z values; and adjusting each of the intensity values as a function of the time needed by the ion trap to begin collecting ions with the corresponding m/z value, wherein the selecting includes selecting the length of the time interval to be the sum of a selected injection time plus an offset time, the offset time being at least as long as the time needed by the ion trap to begin collecting ions with the largest m/z value targeted to be collectible during the time interval.

2. A method comprising:

accumulating ions having a plurality of m/z values in an ion trap during a time interval;

deriving from the accumulated ions a respective intensity value for each of the m/z values; and adjusting each of the intensity values as a function of the time needed by the ion trap to begin collecting ions with the corresponding m/z value, wherein the adjusting includes dividing each intensity value by a respective difference value equal to the time interval less an offset time, the offset time being the time needed by the ion trap to begin collecting ions with the m/z value associated with that intensity.

3. A method comprising:

accumulating ions having a plurality of m/z values in an ion trap during a time interval, wherein the accumulating includes accumulating ions during the time interval that have a further m/z value;

deriving from the accumulated ions a respective intensity value for each of the m/z values, wherein the deriving includes deriving from the accumulated ions an intensity value for the further m/z value; and adjusting each of the intensity values as a function of the time needed by the ion trap to begin collecting ions with the corresponding m/z value, wherein the adjusting is carried out on the intensity values for each of the m/z values other than the further m/z value.

4. A method according to claim 3, wherein the further m/z value is the largest of the m/z values;

wherein each of the m/z values has associated therewith a respective offset time that is the time needed by the ion trap to begin collecting ions with that m/z value; and wherein the time interval is a function of the offset time for the further m/z value.

5. A method comprising:

accumulating ions having a plurality of m/z values in an ion trap during a time interval;

deriving from the accumulated ions a respective intensity value for each of the m/z values;

adjusting each of the intensity values as a function of the time needed by the ion trap to begin collecting ions with the corresponding m/z value;

determining an adjusted total ion current as a function of all the adjusted intensity values corresponding to the time interval;

calculating a time duration as a function of the adjusted total ion current; and thereafter:

accumulating ions having a plurality of m/z values in the ion trap during a time period equal in length to the time duration;

deriving from ions accumulated during the time period a respective further intensity value for each m/z value; and adjusting each of the further intensity values as a function of the time needed by the ion trap to begin collecting ions with the corresponding m/z value, wherein the adjusting of each of the intensity values corresponding to the time interval includes dividing each such intensity value by a respective difference value equal to the time interval less an offset time, the offset time being the time needed by the ion trap to begin collecting ions with the m/z value associated with that intensity; and wherein the determining of the adjusted total ion current includes summing the adjusted intensity values corresponding to the time interval.

6. A method comprising:

accumulating ions having a plurality of m/z values in an ion trap during a time interval;

deriving from the accumulated ions a respective intensity value for each of the m/z values;

adjusting each of the intensity values as a function of the time needed by the ion trap to begin collecting ions with the corresponding m/z value;

determining an adjusted total ion current as a function of all the adjusted intensity values corresponding to the time interval;

calculating a time duration as a function of the adjusted total ion current; and thereafter:

accumulating ions having a plurality of m/z values in the ion trap during a time period equal in length to the time duration;

deriving from ions accumulated during the time period a respective further intensity value for each m/z value; and adjusting each of the further intensity values as a function of the time needed by the ion trap to begin collecting ions with the corresponding m/z value;

wherein the calculating of the time duration includes dividing a target charge of ions for the ion trap by the adjusted total ion current, and then adding to the quotient the time needed by the ion trap to begin collecting ions with the largest m/z value targeted to be collectible during the time period.

7. A method comprising:

accumulating ions having a plurality of m/z values in an ion trap during a time interval;

deriving from the accumulated ions a respective intensity value for each of the m/z values;

adjusting each of the intensity values as a function of the time needed by the ion trap to begin collecting ions with the corresponding m/z value;

calculating a time duration (TD) by successively solving the left side of the following equation with different values of TD to identify a value of TD for which the left and right sides of the equation are approximately equal:

$$\sum_{m/z}\left[\frac{I(m/z)}{TI - OT(m/z)}\cdot(TD - OT(m/z))\right] = TC$$

where TI is the time interval, I(m/z) represents the derived intensity value corresponding to the time interval for a respective m/z value, OT(m/z) is an offset time representing the time needed by the ion trap to begin collecting ions with a respective m/z value, and TC is a target concentration of ions for the ion trap;

accumulating ions having a plurality of m/z values in the ion trap during a time period equal in length to the time duration;

deriving from ions accumulated during the time period a respective further intensity value for each m/z value; and adjusting each of the further intensity values as a function of the time needed by the ion trap to begin collecting ions with the corresponding m/z value.

8. An apparatus comprising:

a first portion that includes an ion trap; and a second portion comprising a controller and a computer-readable medium containing instructions that, when executed by the controller:

causes the ion trap to accumulate ions with a plurality of m/z values during a gate time interval having a length;

derives from the accumulated ions in the ion trap a respective intensity value for each of the m/z values; and adjusts each of the intensity values as a function of a respective offset time, each offset time being a time, of a duration less than the length of the gate time interval, needed by the ion trap to begin collecting ions with the m/z value associated with the respective intensity.

9. An apparatus according to claim 8, wherein the second portion is operable to cause the ion trap to accumulate ions with a plurality of m/z values during a gate time interval of which the length is a predetermined constant.

10. An apparatus according to claim 8, wherein the second portion is operable so as to determine the length of the gate time interval as a function of the m/z values of ions that will be accumulated.

11. An apparatus according to claim 8, wherein the second portion is operable so as to determine the length of the gate time interval as the sum of a selected injection time plus a specific offset time, the specific offset time being at least as long as the time needed by the ion trap to begin collecting ions with the largest m/z value targeted to be collectible during the time interval.

12. An apparatus according to claim 8, wherein the second portion is operable so as to determine the length of the gate time interval as a function of the offset time for the greatest of the m/z values that will be accumulated.

13. An apparatus according to claim 8, wherein the second portion is further operable so as to:

determine an adjusted total ion current as a function of all the adjusted intensity values corresponding to the gate time interval;

calculate a time duration as a function of the adjusted total ion current;

thereafter cause the ion trap to accumulate ions with a plurality of m/z values during a second gate time interval equal in length to the time duration;

derive from the ions accumulated during the second gate time interval a respective further intensity value for each m/z value; and adjust each of the further intensity values as a function of the respective offset time.

14. An apparatus according to claim 8, wherein the second portion is further operable so as to:

calculate a time duration (TD) by successively solving the left side of the following equation with different values of TD to identify a value of TD for which the left and right sides of the equation are approximately equal:

$$\sum_{m/z}\left[\frac{I(m/z)}{TI - OT(m/z)}\cdot(TD - OT(m/z))\right] = TC$$

where TI is the time interval, I(m/z) represents the derived intensity value corresponding to the time interval for a respective m/z value, OT(m/z) is an offset time representing the time needed by the ion trap to begin collecting ions with a respective m/z value, and TC is a target concentration of ions for the ion trap;

thereafter, cause the ion trap to accumulate ions with a plurality of m/z values during a second gate time interval equal in length to the time duration;

derive from the ions accumulated during the second gate time interval a respective further intensity value for each m/z value; and adjust each of the further intensity values as a function of the respective offset time.

15. A method comprising:

accumulating ions having a plurality of m/z values in an ion trap during a time interval;

deriving from the accumulated ions a respective intensity value for each of the m/z values; and adjusting each of the intensity values as a function of a respective offset time, the offset time being a time, of a duration less than the duration of the time interval, needed by the ion trap to begin collecting ions with the m/z value associated with the respective intensity.

16. A method according to claim 15, further comprising, prior to the accumulating, selecting a length for the time interval as a function of the m/z values of ions that will be accumulated.

17. A method according to claim 15, wherein the accumulating includes accumulating ions during the time interval that have a further m/z value;

wherein the deriving includes deriving from the accumulated ions an intensity value for the further m/z value; and wherein the adjusting is carried out on the intensity values for each of the m/z values other than the further m/z value.

18. A method according to claim 17, wherein the further m/z value is the largest of the m/z values; and wherein the time interval is a function of the offset time associated with the further m/z value.

* * * * *